US006419097B1

(12) United States Patent
Anderson

(10) Patent No.: US 6,419,097 B1
(45) Date of Patent: Jul. 16, 2002

(54) ARCHERY BOW AND GUN SUPPORT SYSTEM

(76) Inventor: David Lynn Anderson, 17608 River Ford Dr., Davidson, NC (US) 28036

( * ) Notice: Subject to any disclaimer, the term of this patent is extended or adjusted under 35 U.S.C. 154(b) by 0 days.

(21) Appl. No.: 09/907,231

(22) Filed: Jul. 17, 2001

(51) Int. Cl.[7] ..... A47F 7/00
(52) U.S. Cl. ..... 211/85.7
(58) Field of Search ..... 211/85.7, 64, 60.1, 211/13.1

(56) References Cited

U.S. PATENT DOCUMENTS

| | | | | | |
|---|---|---|---|---|---|
| 602,177 | A | * | 4/1898 | Wiler | |
| 3,022,898 | A | * | 2/1962 | Loeb | |
| 3,045,832 | A | * | 7/1962 | Hibbard | |
| 4,628,893 | A | | 12/1986 | Shaw, III | 124/23 R |
| 4,722,501 | A | * | 2/1988 | Ruhl | |
| 4,936,415 | A | | 6/1990 | Williams | 182/187 |
| 5,039,052 | A | * | 8/1991 | Carafice | |
| 5,138,786 | A | * | 8/1992 | Fischer | |
| 5,310,150 | A | | 5/1994 | Fecko | 248/218.2 |
| 5,482,241 | A | * | 1/1996 | Oglesby | |
| 5,520,164 | A | | 5/1996 | Huddleston | 124/86 |
| 5,630,568 | A | | 5/1997 | Lubrecht | 248/217.4 |
| 5,692,716 | A | | 12/1997 | Himmelsbach | 248/216.1 |
| 5,732,914 | A | | 3/1998 | Flinn | 248/201 |
| 5,769,372 | A | | 6/1998 | Klosterman | 248/219.4 |
| 5,913,667 | A | | 6/1999 | Smilee | 42/94 |
| 6,086,031 | A | | 7/2000 | Renfro | 248/218.4 |

* cited by examiner

*Primary Examiner*—Alvin Chin-Shue
*Assistant Examiner*—Sarah Purol

(57) ABSTRACT

An archery bow and gun support system for holding an archery bow (22) and a shotgun (24) in a readily accessible and desired location is provided. The system includes a male archery bow mount (20), a male shotgun mount (36), and a female field mount (40). The male archery bow mount (20) has a pair of holes (34), which coincide with the manufactured threaded holes near an archery bow's handle. Using two screws, the male archery bow mount (20) is attached to the archery bow (22). The male shotgun mount (36) is attached to the shotgun (24) by securing it under the magazine tube cap (37). Both male mounts include a rail that can be slid into a channel provided by the female field mount (40). The female field mount (40) can be attached to a tree stand, a blind, or flat surface, thus allowing the suspension of the archery bow (22) or shotgun (24) from a desired surface.

7 Claims, 3 Drawing Sheets

ARCHERY BOW AND GUN SUPPORT SYSTEM

CROSS-REFERENCE TO RELATED APPLICATIONS

Not applicable.

BACKGROUND

1. Field of the Invention

The present invention relates to an archery bow and gun support system, specifically a support system for mounting an archery bow and gun on a desired surface, which may include a tree stand, a ground blind, a tree, a wall, or a belt.

2. Description of the Prior Art

Many forms of hunting exist. Some forms, particularly still-hunting, require a hunter to sit or stand for long periods of time and require little or no movement in order to be successful. Examples of still-hunting include archery bow hunting for deer, elk, wild hogs, turkeys, bear, etc or shotgun hunting for deer, turkeys, ducks, etc.

A wide array of factors influences what type of weapon to use on a particular hunt as well as where a particular hunt will take place. Different seasons and laws dictate which type of weapon may be used during a hunt. The different animals being hunted, the weather, the wind, or the time of day may dictate where a particular hunt may take place. A hunter may choose to utilize a ground blind or tree stand for hunting deer. The hunter may also choose whether to use an archery bow or a gun. On that particular day, the hunter may choose to hunt ducks with a gun in a blind, boat, or timber. There are many choices and different situations that occur during the hunting seasons. However, one factor does not change. While still-hunting, the weapon of choice has to be held by the hunter or rested in a safe and desired position. While holding the weapon, the hunter's hands and arms may become fatigued, cold, wet, etc. The hunter's hands will not be free to use other tools of hunting, such as binoculars and calls.

Prior art has shown archery bow holders and gun holders. Some of which solve the problem of holding the weapon. However, a common disadvantage of the prior art is that the holders are not flexible to the many different types of hunts. For example, U.S. Pat. No. 4,936,415 to Williams (1990) discloses a bow holder that is supported on the platform of a tree stand. This particular holder is only useful while archery bow hunting from a tree stand. William's holder also poses the threat of inadvertently knocking the archery bow out of the holder. U.S. Pat. No. 5,913,667 to Smilee (1999) discloses an amphibious gun stand. This particular gun stand does allow a hunter's hands to be free and does keep the gun out of water while hunting in swamp or marsh-like terrains. However, the gun stand is not intended for holding an archery bow and cannot be used in a tree stand. U.S. Pat. No. 6,086,031 to Renfro (2000) discloses a gun and beverage support system that attaches to a tree. While this support system will hold an archery bow and a gun, it can be placed only on a tree or an object of circular shape and will be of no use while hunting in a duck blind or an elevated box blind.

While the mentioned prior art may be suitable for the particular purpose to which they address, they are not suitable for different types of hunts that may present themselves without a minute's notice. A support system that can hold a bow and gun and can be utilized in a tree stand, in timber, and in blinds would be unique and depart from the conventional concepts and designs of the prior art.

SUMMARY

The present invention is a support system for mounting an archery bow and a gun on a desired surface, which may include a tree stand, a tree, a wall, or a belt. According to the present invention, a support system includes a female field mount and a plurality of male mounts. The male mounts may include an archery bow mount and a gun mount, but are not limited to just these mentioned.

A support system is provided between the female and male mounts, so that an object removably fitted with a male mount may be attached to a surface removably fitted with a female mount. The female field mount, in a preferred embodiment, has a rectangular body containing a t-slot channel running parallel to the longer side of the body. The female field mount, in a preferred embodiment, has a predetermined width and length and has a hole at each end for surface attachment. The male archery bow and gun mounts, in a preferred embodiment, have a common characteristic. Each will possess a t-rail of a predetermined width and length that can be slid into and supported by the t-slot channel of the female field mount. While the channel and rail has a t-shaped attachment point in the preferred embodiment, the present invention should not be restricted to this particular shape. Square, circular, triangular, and other shapes of attachment channels may be utilized.

OBJECTS AND ADVANTAGES

Accordingly, several objects and advantages of the present invention are:

(a) to provide an archery bow and gun support system which holds either an archery bow or gun at a hunter's choice;

(b) to provide an archery bow and gun support system which can be utilized in a tree stand, on a tree, in a duck blind, in an elevated blind, or on any flat surface, such as a wall;

(c) to provide an archery bow and gun support system which holds an archery bow and gun stable and secure and will not allow either to be inadvertently knocked out of the holder.

Further objects and advantages are to provide an archery bow and gun support system which holds an archery bow or gun in a readily accessible and desired location, which holds an archery bow and gun in a position which does not interfere with a hunter's sight path of the field, which can be easily carried to and from the field, and which can be manufactured easily and inexpensively. Still further objects and advantages will become apparent from a consideration of the ensuing description and drawings.

DRAWING FIGURES

REFERENCE NUMERALS IN DRAWINGS

Figure 1:
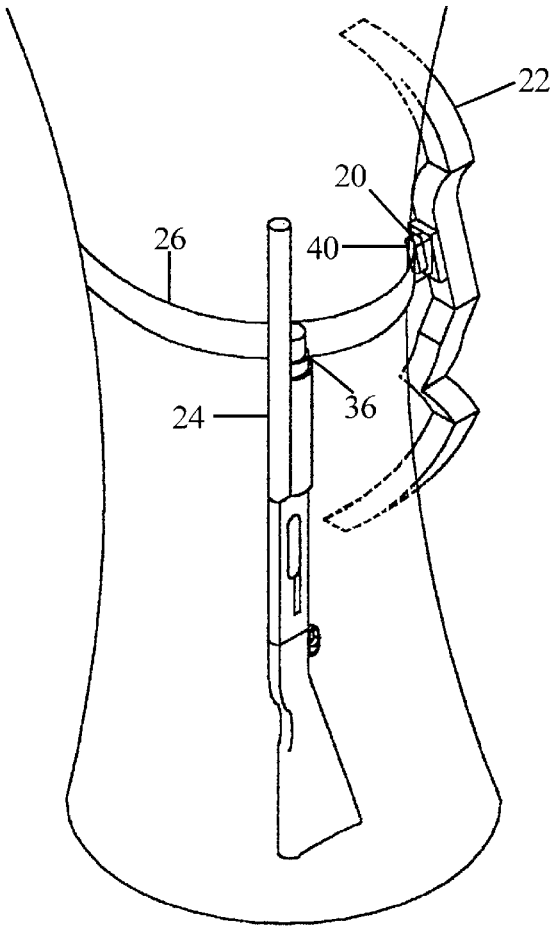
FIG. 1 is a perspective view of the archery bow holder and gun holder of the present invention mounted to a tree.

| | | | |
|---|---|---|---|
| 20 | male bow mount | 22 | archery bow |
| 24 | shotgun | 26 | strap |
| 28 | t-rail | 30 | support beam |
| 32 | support beam leg | 34 | hole A |
| 36 | male shotgun mount | 37 | magazine tube cap |
| 38 | sling slot | 39 | bayonet rail |
| 40 | female field mount | 42 | hole B with beveled edge |
| 44 | t-slot channel | 46 | flat back plate |
| 48 | hole C | 50 | nut |
| 52 | screw | 54 | tree stand tubing |
| 56 | u-shaped back plate | 58 | tree stand |

DESCRIPTION OF THE DRAWING FIGURES

The present invention provides such components allowing an archery bow and a gun to be mounted to a particular surface. The invention includes a female component and male components, whereas a male component removably attached to an object, such as an archery bow or gun, may be held by a surface with a female component removably attached.

FIG. 1 is an oblique drawing, which provides a pictorial view of a method of holding an archery bow 22 and a shotgun 24. Archery bow 22 is connected via male bow mount 20 and female field mount 40. Shotgun 24 is also connected via male shotgun mount 36 and female field mount 40 (not shown here). Female field mounts 40 are held to a tree or the like by a strap 26 fastened about the outside diameter of such a tree or the like.

Figure 2:
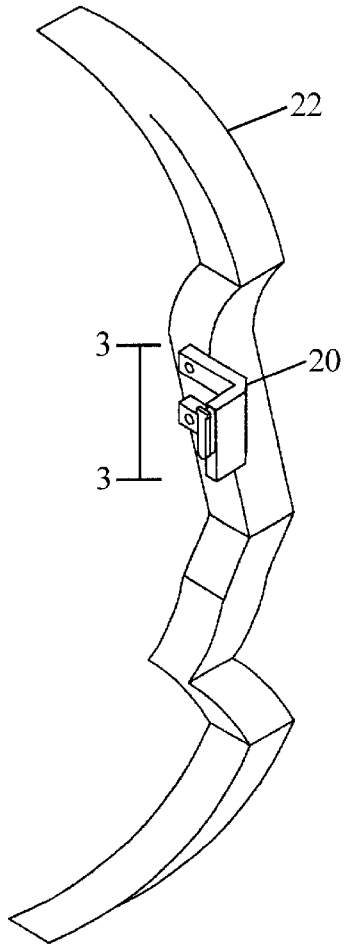
FIG. 2 is a perspective view illustrating the placement of the male bow mount in respect to the archery bow.
Figure 3:
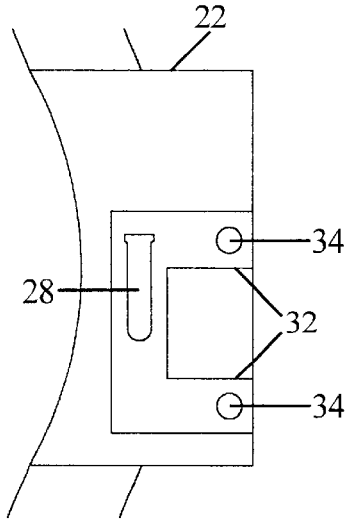
FIG. 3 is a side view along the line 3—3 of FIG. 2.
Figure 4:
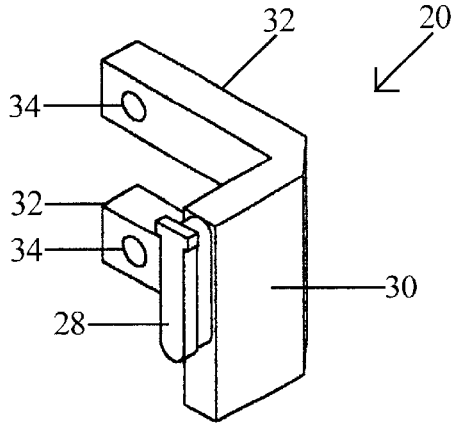
FIG. 4 is a perspective view of the male bow mount.

As shown in FIGS. 2–4, FIG. 3 being a view taken along the line 3—3 of FIG. 2, in a preferred embodiment, male bow mount 20 is generally L-shaped having two support beam legs 32. Support beam legs 32 are a predetermined length, thus allowing space for additional accessories to be mounted to archery bow 22. Additional accessories may include an arrow quiver or a sighting/aiming mechanism. Holes 34 are located at the distal ends of support beam legs 32. The horizontal distance between holes 34 is predetermined and is usually determined by the archery bow 22 manufacturers. Archery bow manufacturers generally provide two threaded receptacles and the dimensions are standard throughout the industry.

Support beam 30, having t-rail 28 at its distal end, is of a predetermined length to allow space for additional accessories, such as those mentioned above, to be mounted to archery bow 22. T-rail 28 shall have a width to be slightly smaller than that of the t-slot channel 44 shown in FIG. 7. The top end of the t-rail 28 shall have width larger that that of the t-slot channel 44 shown in FIG. 7, thus creating a stop.

Figure 5:
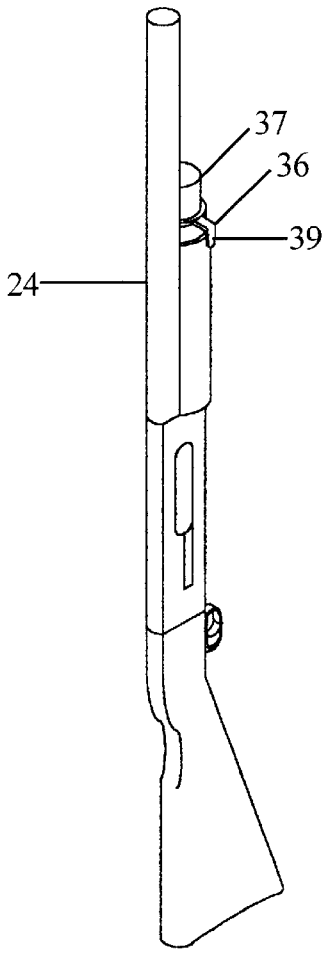
FIG. 5 is a perspective view illustrating the placement of the male shotgun mount in respect to the gun.

As shown in FIG. 5, male shotgun mount 36 is mounted to shotgun 24 under magazine tube cap 37. Magazine tube cap 37 is generally threaded to shotgun 24, thus allowing the male shotgun mount 36 to be squeezed and secured to shotgun 24 under the magazine tube cap 24.

Figure 6:
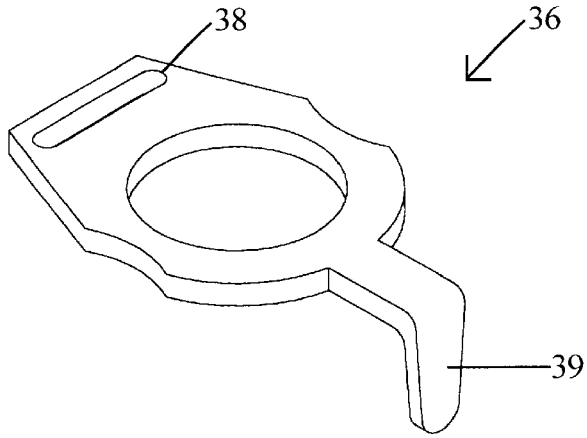
FIG. 6 is a perspective view of the male shotgun mount.

As shown in FIG. 6, the male shotgun mount 36 of the present invention includes a sling slot 38. The sling slot 38 has a predetermined width and length in order to allow a standard sling to pass through. It is to be understood that the sling slot 38 does not add or take away from the spirit and scope of the present invention. When manufacturing the present invention, sling slot 38 may be omitted. Sling slot 38 is merely an added convenience of the present invention.

Figure 7:
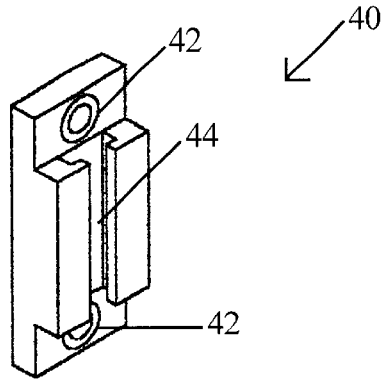
FIG. 7 is a perspective view of the female field mount.

A bayonet rail 39 is set at a perpendicular position and has a predetermined width and length to be smaller than that of the t-slot channel 44 shown in FIG. 7. In a preferred embodiment, the inside diameter of the inner hole of the male shotgun mount 36 is a predetermined size set forth by the outside diameter of the magazine tube of shotgun 24. The inside diameter of the inner hole shall not be smaller than that of the outside diameter of the magazine tube of shotgun 24.

FIG. 7 is a perspective view of female field mount 40 of the present invention. T-slot channel 44 is of a predetermined width and length suitable for supporting the weight of archery bow 22, shotgun 24, or any object coupled with a male mount. The predetermined width shall be a size to accept the t-rail 28 or the bayonet rail 39.

Figure 8:
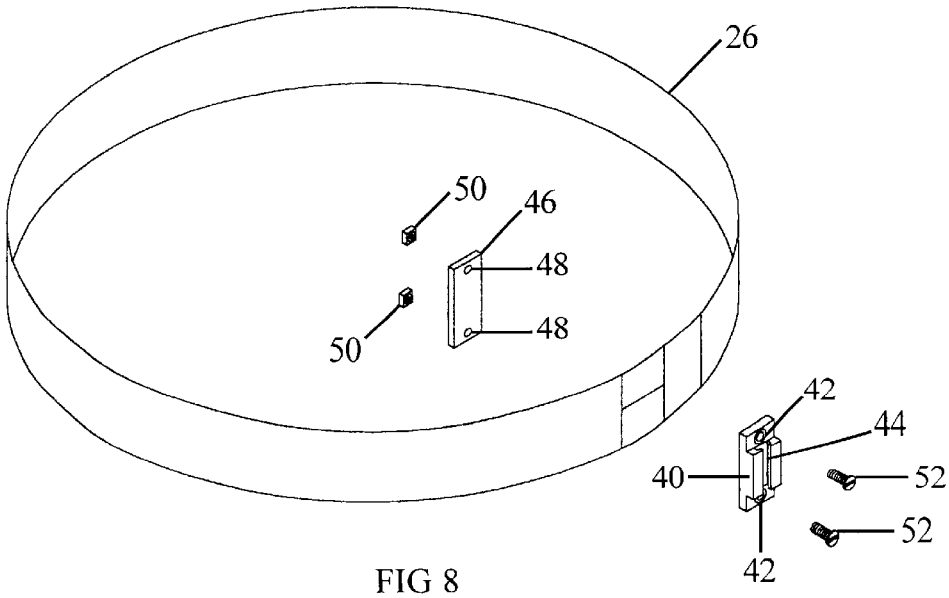
FIG. 8 is an illustration of the female field mount, a flat back plate, two screws, two nuts, and a strap.
Figure 9:
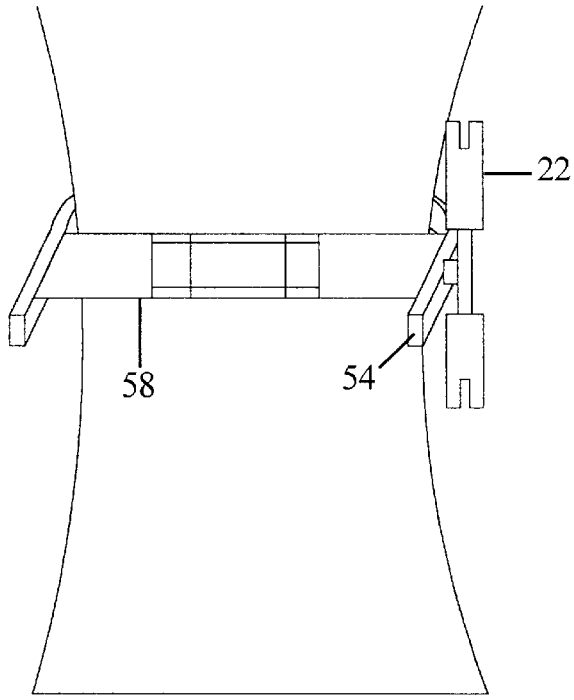
FIG. 9 is a perspective view of the archery bow holder of the present invention mounted to a tree stand.
Figure 10:
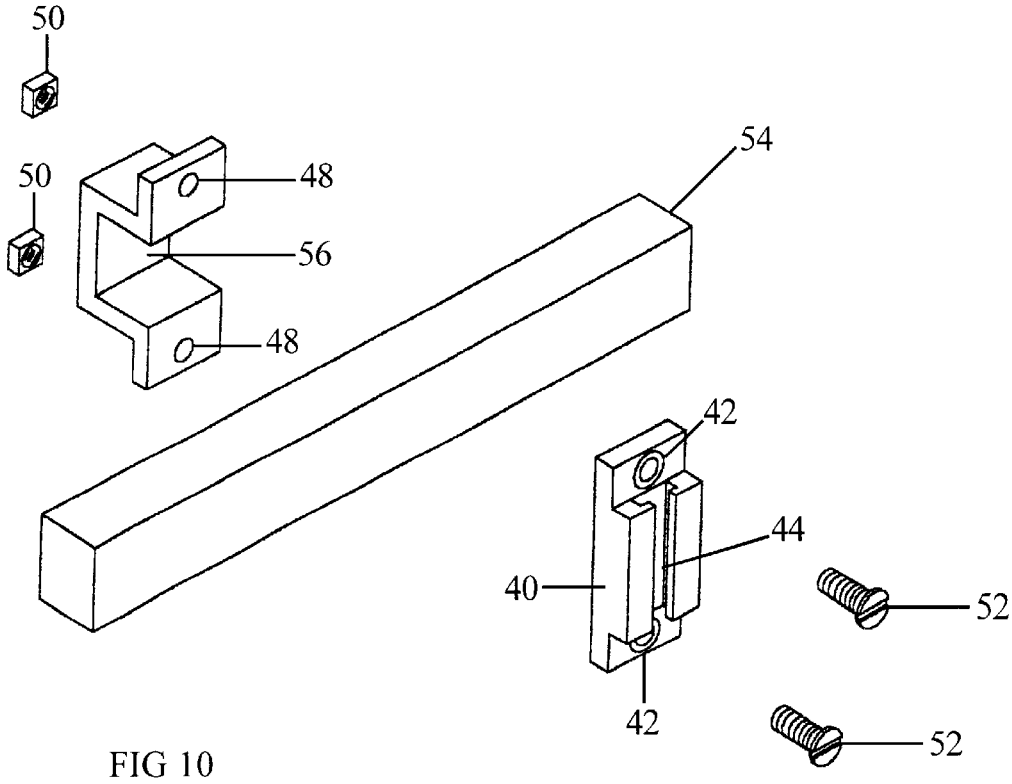
FIG. 10 is an illustration of the female field mount, a u-shaped back plate, two screws, two nuts, and tree stand tubing.

Holes 42 are placed at each end of the female field mount 40 and shall have a beveled edge at a depth that allows screws 52, shown in FIG. 8 and FIG. 10, to fit flush into the female field mount 40. The distance between holes 42 shall be set forth by that of the standard size tree-stand tube 54, shown in FIG. 9.

FIG. 8 is a perspective view of the female field mount 40 and strap 26 mounting hardware. Flat back plate 46 includes two holes 48 to be at the same distance apart as the holes 42 of the female field mount 40. The diameters of holes 48 are to be predetermined by the holes 42 of the female field mount 40.

Screws 52 and nuts 50 shall have matching threads and diameters. The length of screws 52 shall be predetermined by the width of female field mount 40 and either the flat back plate 46 or u-shaped back plate 56 shown in FIG. 10. Strap 26 has a width predetermined by the distance between holes 42 of the female field mount 40.

FIG. 9 is pictorial view of a method of holding the archery bow 22 on a deer stand 58.

FIG. 10 is a perspective view of female field mount 40 and tree stand tubing 54 mounting hardware. U-shaped back plate 56 includes two holes 48 to be at a distance and having a diameter of those depicted in FIG. 8. The u-shaped back plate has a u-nshaped channel having a depth and width predetermined by that of the tree stand tubing 54 shown in FIG. 9. Screws 52 and nuts 50 have a thread, diameter, and length of those shown in FIG. 8.

OPERATION

All of the above embodiments combine to form an archery bow and gun support system for holding an archery bow and gun in a readily accessible and desired location. The female field mount 40 may be attached to a flat surface, a strap 26, or a tree stand 58 via the tree stand tubing 54. By utilizing holes 42 and driving screws 52 into a flat surface, the female field mount 40 can be secured to such a flat surface as a blind or wall.

By placing a strap 26 between the female field mount 40 and flat back plate 46 and securing by placing screws 52 through holes 42 and 48 and placing nuts 50 around screws 52, the female field mount 40 and strap 26 may encircle a surface, such as a tree. By placing tree stand tubing 54 of tree stand 58 between the female field mount 40 and the u-shaped back plate 56 and securing by placing screws 52 through holes 42 and 48 and placing nuts 50 around screws 52, the female field mount 40 will secure to the tree stand tubing 54.

Male bow mount 20 may be attached to the archery bow 22 at the threaded receptacles located near the center of archery bow 20. Place manufacturer provided screws through holes 34 of support beam legs 32 and into the threaded receptacles of archery bow 22. T-rail 28 located on support team 30 may then be slid into t-slot channel 44 of the female field mount 40 which can be placed on any of the locations mentioned above. This process allows archery bow 20 to be placed at a readily accessible and desired location.

Male shotgun mount 36 may be attached to shotgun 24 by removing the magazine tube cap 37 and placing the male shotgun mount 36 over the magazine tube. By replacing the magazine tube cap 37 tightly, the male shotgun mount 36 will be secured to shotgun 24. Bayonet rail 39, adjacent sling slot 38, may be slid into t-slot channel 44 of female field mount 40. This process allows shotgun 24 to be placed at a readily accessible and desired location.

With the use of the components of the present invention, the archery bow and gun holder support system is truly a unique and novel invention.

CONCLUSION, RAMIFICATIONS, AND SCOPE

The reader will see that the archery bow and gun support system provides a safe reliable, lightweight, and economical system that can be utilized by all types of hunters. The present invention will provide:

(a) an archery bow and gun support system which holds either an archery bow or gun at a hunter's choice;

(b) an archery bow and gun support system which can be utilized in a tree stand, on a tree, in a duck blind, in an elevated blind, or on any flat surface, such as a wall;

(c) an archery bow and gun support system which holds an archery bow and gun stable and secure and will not allow either to be inadvertently knocked out of the holder.

While my above description contains many specifications, these should not be construed as limitations on the scope of the invention, but rather as an exemplification of one preferred embodiment thereof. Many other variations of the present invention are possible.

For example, the materials used may be aluminum, steel, poly materials, etc. In determinig the materials to be used, it is obvious that the components may be extruded, milled, cut, or molded.

Another example is the u-shaped back plate. While the preferred embodiment includes a u-shaped channel, a semi-circle channel or any other variation may be included to better fit the tree stand or blind tubing.

Another example is the t-slot channel and rails. The preferred embodiment utilizes a t-slot and t-rail to hold the archery bow and gun secure. It is obvious that this channel may be circular, triangular, or any shape of such nature.

Yet another example or variation may be the addition of male mounts. It can be foreseen that a male mount including the bayonet rail or t-rail can be placed on many other items and used to hang such items. Example items may include an umbrella, a scooter, a hook, etc.

Accordingly, the scope of the invention should be determined not by the preferred embodiments illustrated, but by the appended claims and their legal equivalent.

I claim:

1. A weapon support system specifically adapted to support an archery bow and a shotgun on a desired surface, the support system comprising in combination:

an archery bow having threaded receptacles to accept an archery related accessory; and an L-shaped male bow mount including a plurality of holes adapted to mate with said threaded receptacles of said archery bow; and a shotgun having a magazine tube; and a male shotgun mount including a hole adapted to mate with the said magazine tube; and a female mount including a plurality of holes adapted to mate with a desired surface, whereby the male bow mount may be semi-permanently attached to the bow, the male shotgun mount may be semi-permanently attached to the shotgun, and the female mount may be semi-permanently attached to a desired surface, thereby enabling the archery bow and the shotgun to be removably secured to the desired surface.

2. The female mount of claim 1, wherein said plurality of holes comprises:

a pair of holes at distal ends of said female mount; and said holes including a beveled edge.

3. The female mount of claim 1 comprises:

a t-slot channel of a predetermined length and width; and a t-slot channel at a point along its length.

4. The male bow mount of claim 1, wherein said plurality of holes comprises:

a pair of holes a pair of holes adapted to mate with said threaded receptacle of said archery bow.

5. The male bow mount of claim 1 comprises:

a t-rail parallel to said bow's upright structure; and said t-rail at a point along distal end opposite end including holes.

6. The male shotgun mount of claim 1, wherein said hole comprises:

a diameter of a predetermined length to allow said male shotgun mount to pass around said magazine tube.

7. The male shotgun mount of claim 1 comprises:

a bayonet rail of predetermined length and width; and a bayonet rail attached to base of said shotgun mount at a perpendicular angle.

* * * * *